US007451518B1

(12) United States Patent
Koumarianos

(10) Patent No.: US 7,451,518 B1
(45) Date of Patent: Nov. 18, 2008

(54) MULTI-ROLLER APPLICATOR FOR PAINTING

(76) Inventor: Angelo Koumarianos, 1845 Forough Cir., Port Orange, FL (US) 32129

( * ) Notice: Subject to any disclaimer, the term of this patent is extended or adjusted under 35 U.S.C. 154(b) by 0 days.

(21) Appl. No.: 11/894,551

(22) Filed: Aug. 22, 2007

(51) Int. Cl.
*B05C 1/08* (2006.01)
*B05C 17/02* (2006.01)

(52) U.S. Cl. ..... 15/230.11; 492/13; 492/19

(58) Field of Classification Search ..... 15/230.11; 492/13, 19
See application file for complete search history.

(56) References Cited

U.S. PATENT DOCUMENTS

| | | | | |
|---|---|---|---|---|
| 3,358,312 | A * | 12/1967 | Parr | 15/230.11 |
| 4,335,483 | A * | 6/1982 | Buck | 15/230.11 |
| 5,090,084 | A * | 2/1992 | De Guzman | 15/230.11 |
| 6,219,877 | B1 * | 4/2001 | Lowrey et al. | 15/230.11 |
| 6,973,696 | B1 * | 12/2005 | Koumarianos | 15/230.11 |

* cited by examiner

*Primary Examiner*—Randall Chin
(74) *Attorney, Agent, or Firm*—Clifford G. Frayne

(57) ABSTRACT

A multi-roller applicator for the application of paint having a handle member and a frame member, the frame member having secured thereto in parallel relationship, a pair of spaced apart axles for the receipt of a frame core member and paint absorbing sleeve member rotationally mounted thereon for the application of paint.

7 Claims, 5 Drawing Sheets

MULTI-ROLLER APPLICATOR FOR PAINTING

BACKGROUND OF THE INVENTION

1. Field of the Invention

The present invention relates to painting and in particular to applicators such as paint rollers, and more particularly to a multi-roller paint applicator.

2. Description of the Prior Art

The application of paint is accomplished normally in one of three ways. For large, uninterrupted areas, paint is normally applied by spraying. For small areas, or detail work such as around door frames and window frames, a paint brush is usually employed. For larger areas of walls or ceilings which have interrupted areas, the paint is normally applied with a paint roller which allows the user to cover a greater quantity of area in less time.

Present paint rollers are normally of one piece construction and fabricated from an elongate metal rod member. The metal rod is formed into a straight handle end which is then bent at an angle generally perpendicular to handle and then rebent to define a length which is parallel to the handle and rebent a third time to form the roller support portion which is perpendicular to the handle end and which would normally be bisected by the handle end if the handle end were extended beyond the first right angle. The roller support portion of the metal rod slidably mechanically receives the paint roller and the internal frame upon which the paint roller is mounted. The paint roller and frame rotate freely on the rod portion. The roller is constructed of an outer layer of paint absorbing material and depending upon the surface which it is going to be used to cover, the paint roller is normally characterized as a rough or a finish roller.

The paint is normally poured into a receptacle having a tilted base which allows the user to via the handle end of the paint roller to place the roller into a quantity of paint and rotate the roller on the angled surface so that sufficient paint is absorbed on the outer surface of the roller. The user then contacts the roller with the surface to be painted and with a back and forth, or up and down motion causes the roller to rotate applying paint to the surface.

The handle end of the roller can vary in length depending on the type of painting required. For high walls or for ceilings, the handle end may be several feet long to allow the user to reach the area to be painted without having to use an elevation means. For a standard height wall, the handle portion may average approximately one foot.

The design standard in the United States for paint rollers utilizes an internal frame member slidably frictionally or mechanically engaged to the roller support portion of the paint roller and an absorbent sleeve which slidably engages the frame member. When the slidable absorbent sleeve is worn out or has served its purpose, it is normally discarded, but the internal frame member is retained for use with a future clean absorbent sleeve.

In European practice, there is no internal frame member. The absorbent sleeve is formed with fixed end members which slidably engage the metal rod support of the paint roller. In European practice when the absorbent sleeve becomes worn out or has served its purpose, the sleeve and the end members are discarded as a unit.

Applicant's multi-roller applicator is adaptable to both the United States Standard and the European Standard.

Depending upon the surface to be painted, the user may have to apply several coats of paint. This could require two coats with the same type of roller or a first coat with a rough roller followed by a second coat with a finish roller.

While the application of paint by a paint roller is much quicker than if applied by a brush, the application by means of a paint roller may require the user to paint over the same surface area a plurality of times.

Applicant's invention provides for a multi-roller assembly in which two or more rollers are secured in parallel alignment on a single handle means. The rollers may rotate independently or the rollers may be juxtaposed such that the rotation of one roller causes the other roller to rotate by frictional engagement. This type of assembly allows the user to mount a combination of finish rollers or rough rollers on the applicator means depending upon the surface to be painted and allows for more paint to be applied in less time.

OBJECTS OF THE INVENTION

An object of the present invention is to provide for a novel paint applicator in which a plurality of paint rollers are mounted.

Another object of the present invention is to provide for a novel paint applicator in which a plurality of rollers simultaneously apply painting to the surface desired.

A still further object of the present invention is to provide for a novel paint applicator in which the plurality of rollers rotate independently.

A still further object of the present invention is to provide for a novel paint applicator wherein one of the plurality of rollers in rotation causes the rotation of the adjacent roller.

A still further object of the present invention is to provide for a novel paint applicator in which the user can combine rollers of the rough finish type and the fine finish type.

A still further object of the present invention is to provide for a novel paint applicator which allows more paint to be deposited on the surface to be painted than with a single roller.

A still further object of the present invention is to provide for a novel paint applicator which decreases the number of coats of paint that may have to be applied to the surface to be painted.

A still further object of the present invention is to provide for a novel paint applicator adaptor which allows the paint applicator having a single roller to be converted to a paint applicator having a plurality of rollers.

SUMMARY OF THE INVENTION

A multi-roller applicator for the application of paint having a handle member and a frame member, the frame member having secured thereto in parallel relationship, a pair of spaced apart axles for the receipt of a frame core member and paint absorbing sleeve member rotationally mounted thereon for the application of paint.

BRIEF DESCRIPTION OF THE DRAWINGS

These and other objects of the present invention will become apparent particularly when taken in light of the following illustrations wherein.

DETAILED DESCRIPTION OF THE INVENTION

Figure 7:
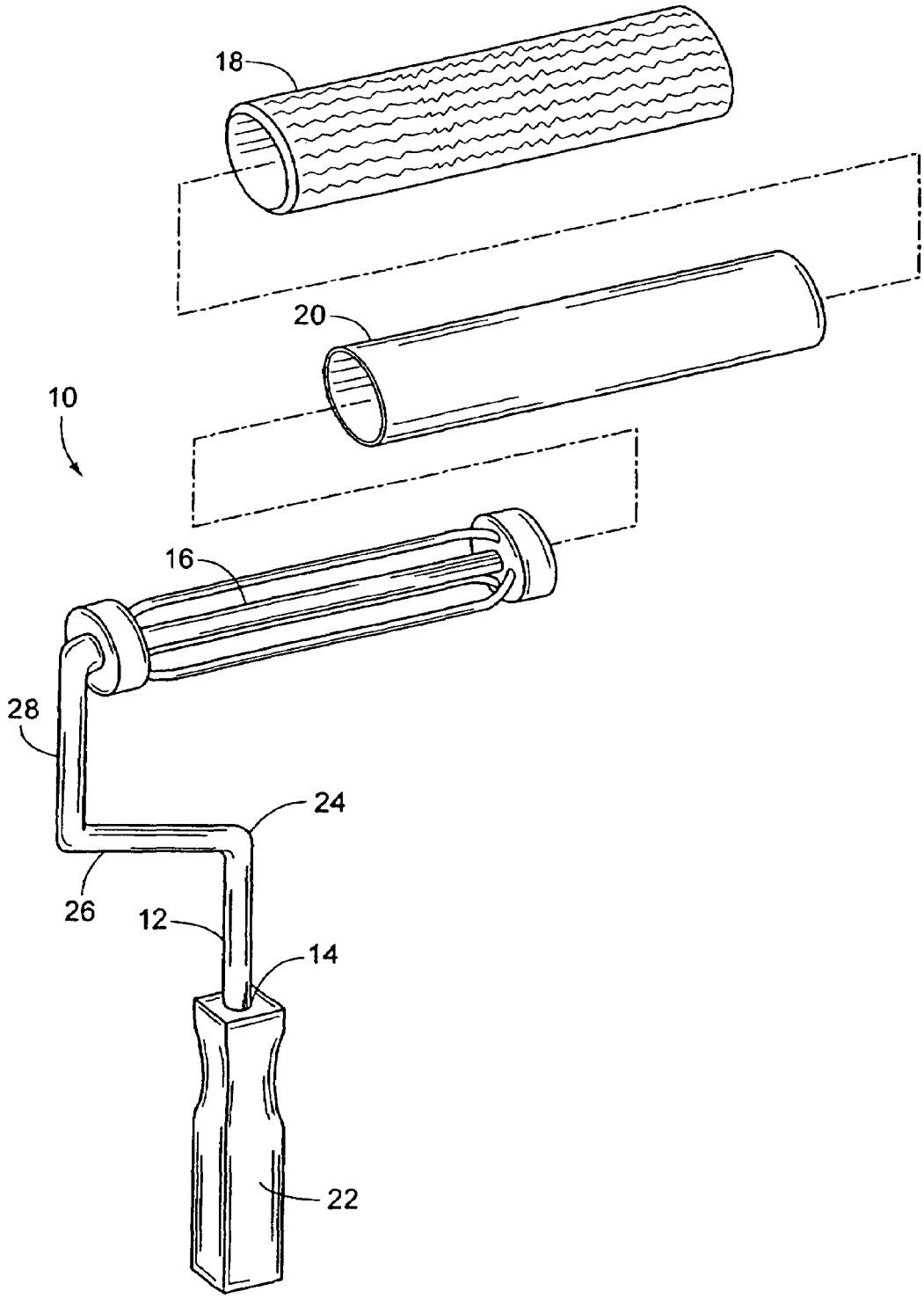
FIGURE 7 PRIOR ART
FIG. 7 is a perspective exploded view of a paint roller assembly of the prior art.

FIG. 7 is a planar top view of a painting roller assembly of the prior art. Paint roller 10 consists of a rod member 12 which is bent and/or angled so as to serve both as a handle portion 14 and an axle 16 for a rotational paint sleeve 18 and frame or core member 20. The handle portion 14 of rod 12 is fitted with a frictional grip 22. The handle portion 14 of rod 12 is first bent or angled at 24 so as to form a right angle or an obtuse angle with handle portion 14 and is identified by segment 26. The rod member is then again bent or angled to form segment 28 which is substantially parallel to handle portion 14. Segment 28 is then bent at a 90 degree angle to form the axle portion 16 for support of frame or core member 20 and paint sleeve 18 the circumference of which is covered by a paint absorbing material such as felt, fleece or foam. As a general design, the extension of handle member 14 would bisect the axle member 16 thereby providing ease of use by the user.

Typically frame or core member 20 paint absorbing sleeve member 18 are in snap fit engagement on axle member 16 and can be slidably removed therefrom with the paint sleeve member 18 being separated from frame or core member 20 for ease of cleaning.

Figure 1:
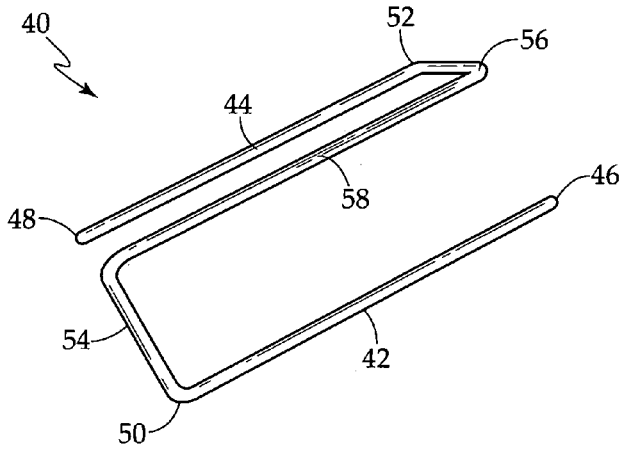
FIG. 1 is a perspective view of the roller support of the paint roller assembly of the present invention.
Figure 2:
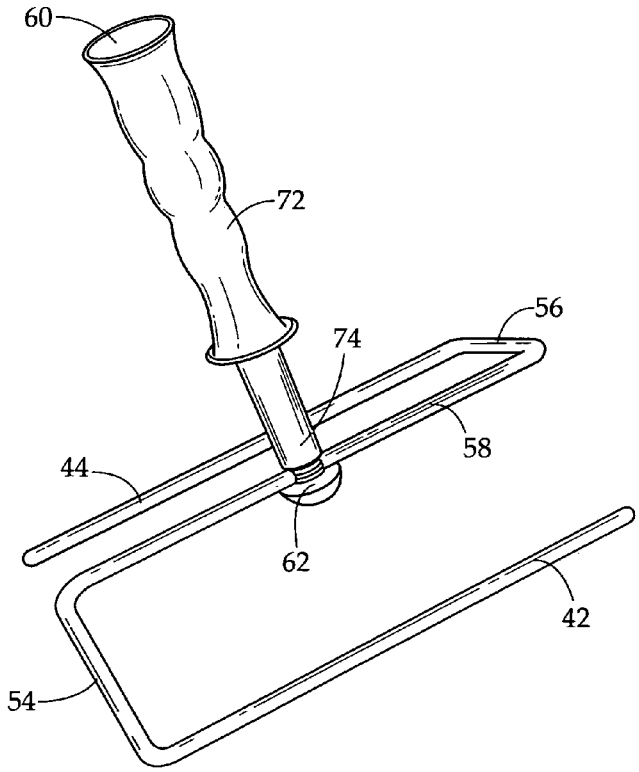
FIG. 2 is a perspective view of the roller support of the present invention, including handle member.

FIGS. 1 and 2 are perspective views respectively of the roller support frame 40 of the present invention, and the roller support handle member. When viewed from above as illustrated in FIG. 1, roller support frame 40 has an S-shaped configuration. When viewed from the end as illustrated, the roller support frame 40 has an inverted V-shape configuration.

In the preferred embodiment, roller support frame 40 would be formed from bending a single metal rod at multiple 90 degree angles, however, roller support frame 40 could also be molded as one piece from plastic.

Roller support arm 40 comprises a first roller axle 42 and a second roller axle 44 parallelledly disposed. First roller axle 42 and second roller axle 44 have an open paint roller insertable end 46 and 48 respectively, and a closed support end 50 and 52. Closed support ends 50 and 52 comprise an angularly disposed perpendicular arms 54 and 56 respectively, which communicate with a handle support arm 58, which again is parallelledly disposed with the first roller axle 42 and second roller axle 44.

The open paint roller insertable ends 46 and 48 of first roller axle 42 and second roller axle 44 are at opposing ends of the roller axles as are the angularly disposed perpendicular arms 54 and 56 at the closed support ends. As will be described hereafter, the paint rollers are slidably disposed onto first roller axle 42 and second roller axle 44 such that the paint rollers are disposed with a gap therebetween to allow the paint rollers to freely rotate on first roller axle 42 and second roller axle 44.

Figure 3:
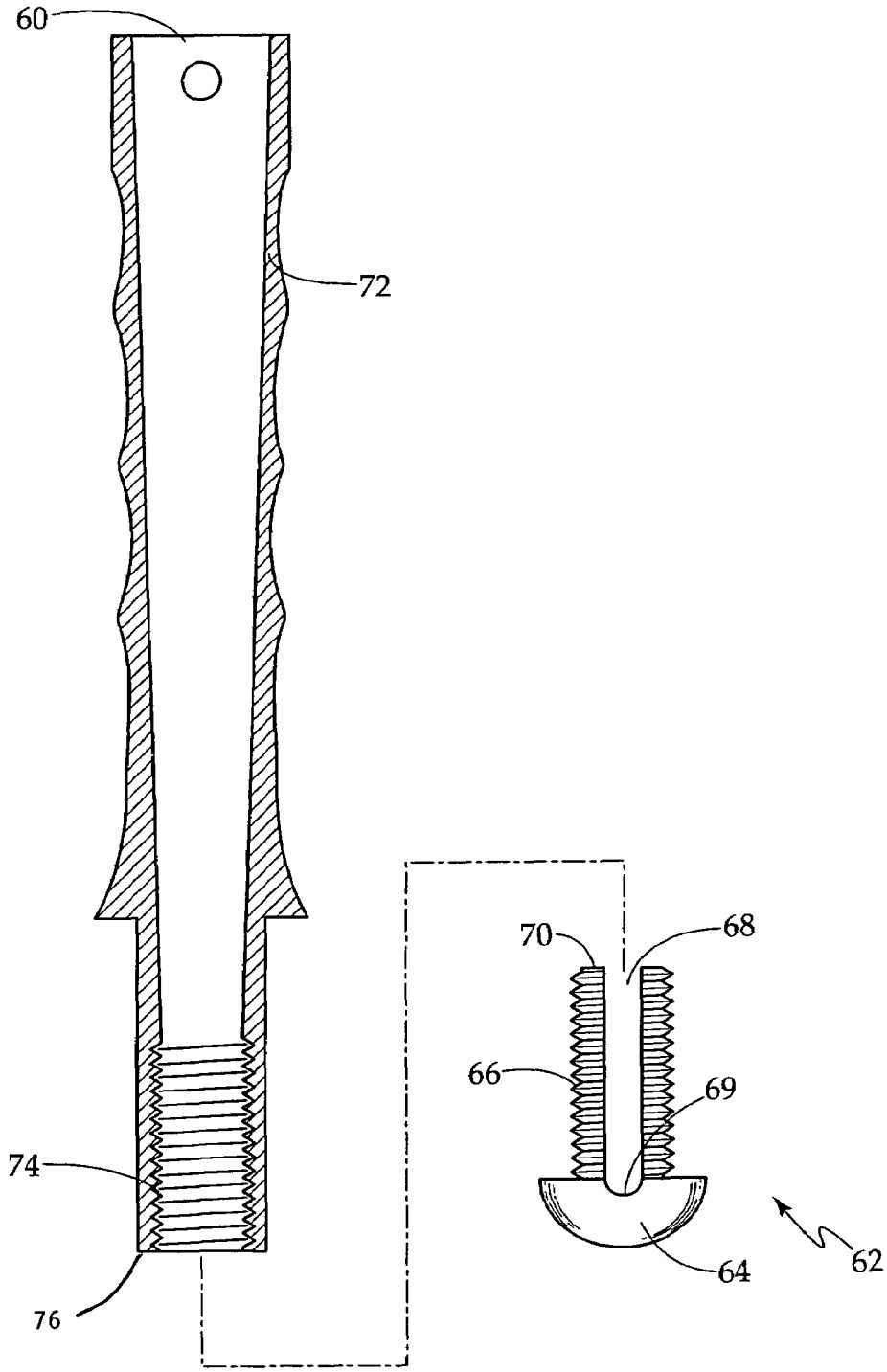
FIG. 3 is an exploded cross section view of the handle member.

FIG. 3 is an exploded, cross sectional view of the handle member 60 illustrating the preferred manner in which it is secured to handle support arm 58 of roller support member 40. Handle member 60 is of two piece construction comprising a bolt portion 62 having a head portion 64 and a threaded shaft 66. Shaft 66 has a transverse slot 68 extending from end 70 to a point proximate head 64. Handle portion 72 is of tubular construction having an internal threaded bore 74, cooperable with the external threaded shaft 66 on bolt portion 62. Handle portion 72 can be of relative short length for the application of paint in an easily reachable area, or alternatively, handle portion 72 can be of greater length for the application of paint in elevated or hard to reach areas.

In assembly, the slot 68 on bolt portion 62 of handle member 60 is slidably engaged with handle support arm 58 of roller support frame 40. Handle portion 72 is then threadedly mated with bolt portion 62 until the terminus 76 of handle portion 72 frictionally engages handle support arm 58. Handle support arm 58 is thus wedged between the terminus 69 of slot 68 and the terminus 76 of handle portion 72 of handle member 60.

Figure 6:
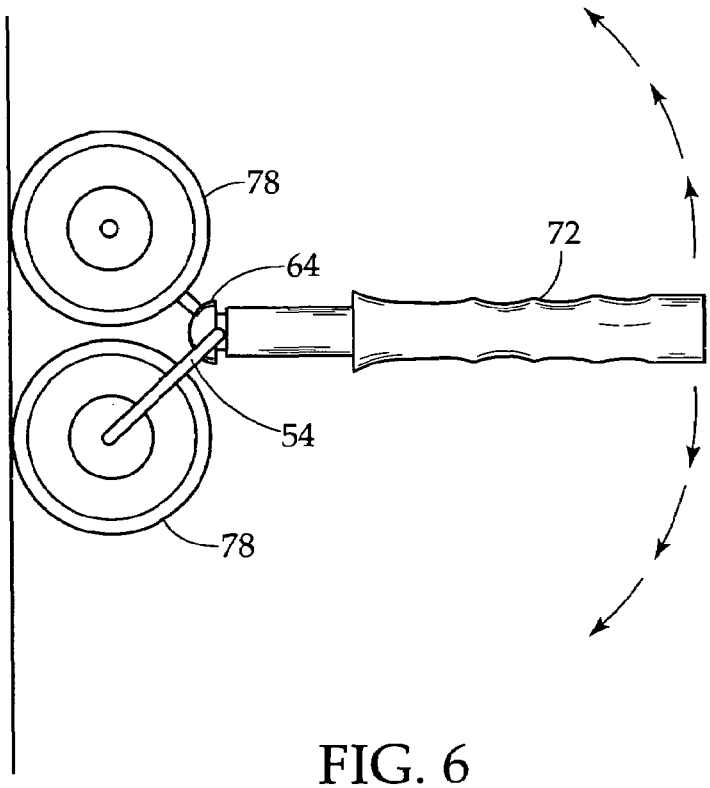
FIG. 6 is a side view of the operation of the roller assembly.

By adjusting the friction and/or rotation of handle portion 72 in cooperation with bolt portion 62, the degree of rotation of handle support arm 58 may be adjusted. For example, if handle portion 72 is threadedly tightened to securely engage handle support arm 58, handle support arm 58 will not rotate in slot 68 and the first roller axle and second roller axle and their respective application sleeves will not change their angular position vis-à-vis handle portion 72. If the frictional engagement between handle portion 72 and handle support arm 58 is lessened, then handle support arm 58 is allowed to slightly rotate in slot 68 and thus the orientation of first roller axle 42 and second roller axle 44 will change as respects handle portion 72 (See FIG. 6).

Figure 4:
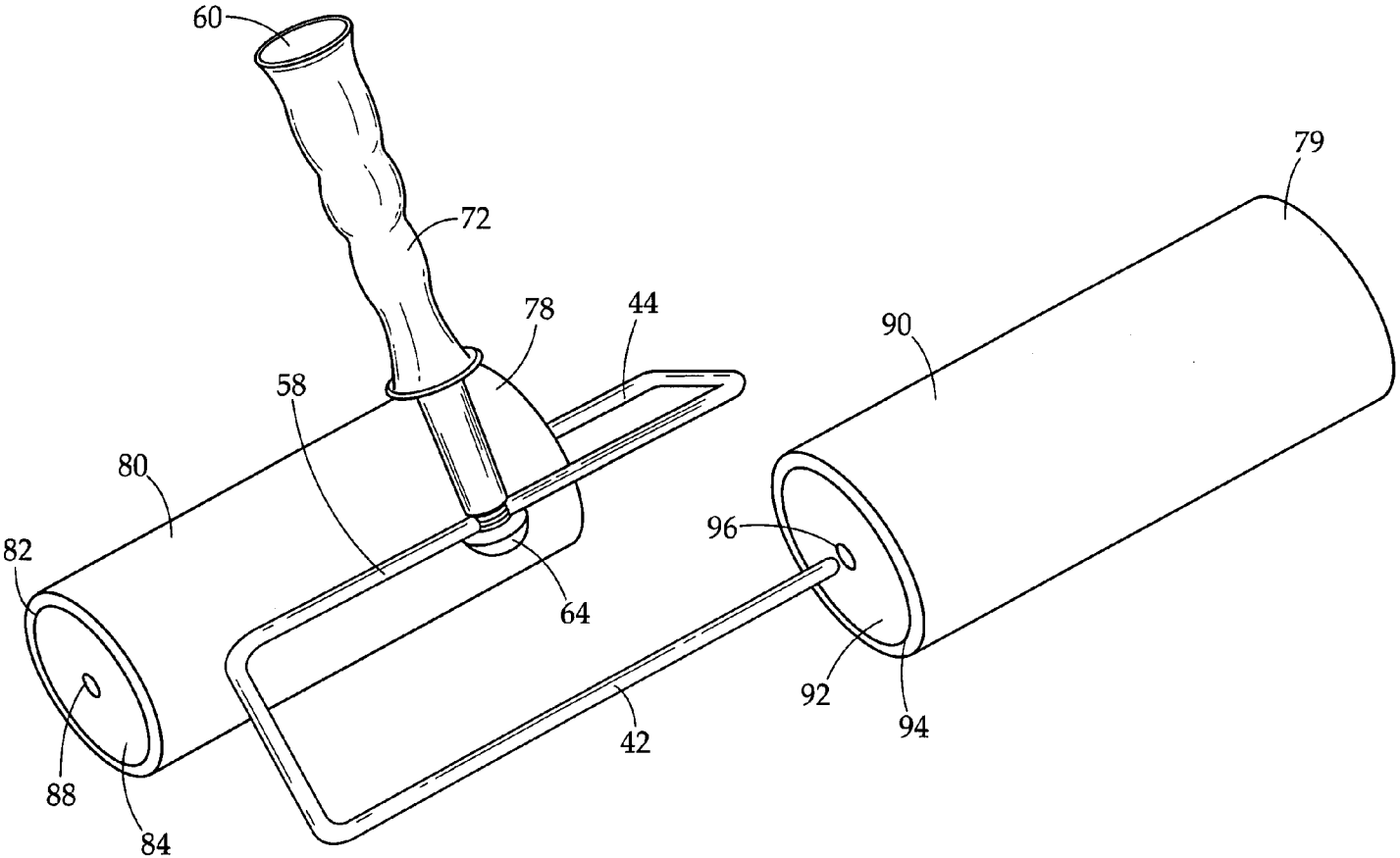
FIG. 4 is a perspective view of the roller support handle member and paint rollers.

FIG. 4 is a perspective view of the paint roller assembly utilizing a U.S. standard paint roller 78 and a European standard paint roller 79. The U.S. standard paint roller 78 as illustrated in FIG. 7 is adapted to fit the roller support axle 42 or 44 of the present invention. In the U.S. standard, a rotational paint sleeve 80 made of felt, fleece, or other paint absorbing textile, is secured to a core member 82. Core member 82 is adapted to the roller axles 42 and 44 of the present invention by means of end caps 84 which frictionally snap fit into the core member 82. End caps 84 have a central aperture 88 therethrough complimentary with the diameter of the roller axles 42 and 44 of the present invention. In this configuration, an assembled U.S. standard paint roller 78 can be slidably secured onto each of the roller axles 42 and 44. When the U.S. standard paint roller 78 becomes worn through use and is no longer suitable or fit for performing paint application, the paint sleeve 80 and core member 82 may be discarded, or only the paint sleeve 80 need be discarded and a new paint sleeve slidably engaged with the core member. Thus the core member and the end caps are suitable for reuse.

FIG. 4 also illustrates the European roller standard 79. In the European roller standard 79, the paint applicator sleeve 90, core member 92, and end caps 94 are of single piece, unitary construction. In the European version, the paint application sleeve 90, core member 92, and end caps 94 are discarded when worn as a unit. However, Applicant's roller support frame 40 has dimensioned the roller axles 42 and 44 to accommodate the apertures 96 in the fixed end caps 94 of the European standard so that a European standard roller applicator may be used with Applicant's roller support frame 40.

Figure 5:
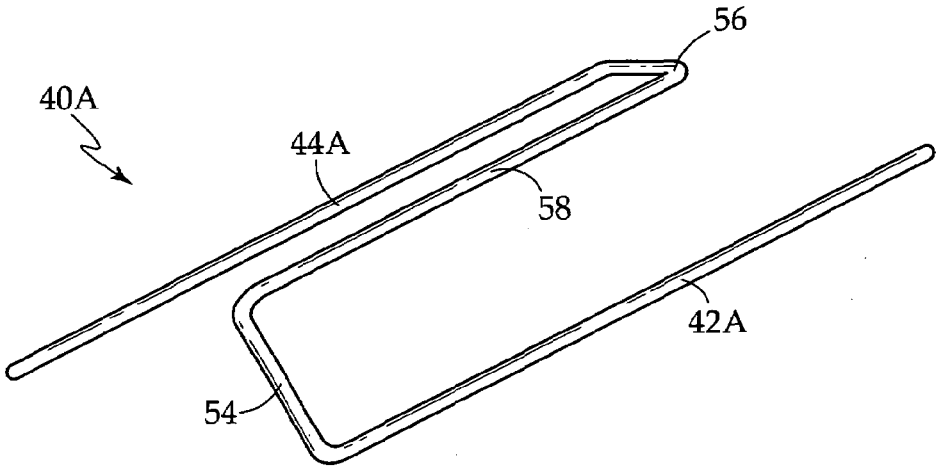
FIG. 5 is a perspective view of the roller support with extended axles for accommodating multiple rollers for larger coverage area.

FIG. 5 is a perspective view of a second embodiment of a roller support 40A which would be utilized simultaneously to apply paint over a larger area with each passage of the roller support 40A. In this configuration, roller axle 42A, or roller axle 44A, or both, could be extended to accommodate more than one paint roller 78 or 79 on each axle. In such a configuration, the interior rollers would apply paint in tandem since they would still remain in alignment with the exterior paint rollers applying only a single layer of paint. This embodiment would have advantages where it was desirable to quickly and efficiently apply paint to a large area without the concern of the finished texture.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A multi-roller applicator for the application of paint to a surface, said applicator comprising:

a frame member, said frame member comprising a first roller axle having a first end and a second end, a second roller axle having a first end and a second end, said first roller axle and said second roller axle in parallel spaced apart relationship;

a support member having a first end and a second end, said support member parallelledly disposed with said first and second roller axles, said support member secured to said first end of said first roller axle by an arm member secured to said first end of said support member, said support member secured to said second end of said second roller axle by an identical arm member secured to said second end of said support member, said arm members defining the closed end of said first and second roller axles, said opposing end being open for the slidable insertion of a paint roller onto said first and second roller axles;

a paint roller disposed on each of said first and second roller axles, said paint roller comprising a paint absorbing sleeve applicator for absorption of paint, said sleeved applicator mounted on a tubular core member, said tubular core member having end caps secured thereto, said end caps having a centrally disposed aperture for slidable engagement with said first and second roller axles for rotational application of paint to a surface; and a handle member perpendicularly, centrally secured to said support member, said handle member comprises a two piece assembly of a bolt member having a head end and an externally threaded shaft end, said externally threaded shaft end having a diametric transverse slot extending through a portion thereof for the slidable perpendicular receipt of a portion of said support member of said frame, said handle member having a handle gripping portion having a first end formed with an internal threaded bore cooperative with said externally threaded shaft of said bolt member to secure the orientation of said support member of said frame by frictionally engaging said portion of said support member within said diametric transverse slot of said bolt member.

2. The multi-roller applicator for the application of paint to a surface in accordance with claim 1 wherein said frame member is of one piece unitary construction formed by bending a metal rod at a plurality of right angles to form said frame.

3. The multi-roller applicator for the application of paint to a surface in accordance with claim 1 wherein said first and second axles and said support member are of equal length.

4. The multi-roller applicator for the application of paint to a surface in accordance with claim 1 wherein said first roller axle and said second roller axle each accommodate a single paint roller.

5. The multi-roller applicator for the application of paint to a surface in accordance with claim 1 wherein said first axle and said second axle are of a length greater than said support arm so as to permit each roller axle to accommodate a plurality of said paint rollers.

6. The multi-roller applicator for the application of paint to a surface in accordance with claim 1 wherein said paint absorbing sleeve, said tubular core member and said end caps are of one piece construction and disposed as a unit.

7. The multi-roller applicator for the application of paint to a surface in accordance with claim 1 wherein said paint absorbing sleeve is slidably removably disposed on said tubular core member and said end caps are removably snap fit to said tubular core member.

* * * * *